US008500530B2

(12) United States Patent
Herbert

(10) Patent No.: US 8,500,530 B2
(45) Date of Patent: Aug. 6, 2013

(54) WAGERING SYSTEM AND METHOD OF WAGERING

(76) Inventor: Richard A. Herbert, Riverside, IL (US)

( * ) Notice: Subject to any disclaimer, the term of this patent is extended or adjusted under 35 U.S.C. 154(b) by 7 days.

(21) Appl. No.: 13/276,569

(22) Filed: Oct. 19, 2011

(65) Prior Publication Data

US 2012/0094729 A1 Apr. 19, 2012

Related U.S. Application Data

(60) Provisional application No. 61/394,666, filed on Oct. 19, 2010.

(51) Int. Cl.
*A63F 9/24* (2006.01)

(52) U.S. Cl.
USPC ..... 463/6; 463/25; 463/28

(58) Field of Classification Search
USPC ..... 463/6, 22, 25
See application file for complete search history.

(56) References Cited

U.S. PATENT DOCUMENTS

| | | | | |
|---|---|---|---|---|
| 5,513,103 | A * | 4/1996 | Charlson | 700/93 |
| 5,830,068 | A * | 11/1998 | Brenner et al. | 463/42 |
| 5,888,136 | A * | 3/1999 | Herbert | 463/22 |
| 6,120,376 | A * | 9/2000 | Cherry | 463/16 |
| 6,152,822 | A * | 11/2000 | Herbert | 463/22 |
| 6,325,721 | B1 * | 12/2001 | Miyamoto et al. | 463/40 |
| 7,306,514 | B2 * | 12/2007 | Amaitis et al. | 463/6 |
| 7,645,191 | B1 * | 1/2010 | McKeever | 463/6 |
| 2004/0104845 | A1 * | 6/2004 | McCarthy | 342/463 |
| 2004/0229671 | A1 * | 11/2004 | Stronach et al. | 463/6 |
| 2004/0235542 | A1 * | 11/2004 | Stronach et al. | 463/6 |
| 2008/0278314 | A1 * | 11/2008 | Miller et al. | 340/539.13 |
| 2011/0112663 | A1 * | 5/2011 | Stein | 700/93 |

OTHER PUBLICATIONS

"Horse Racing Spread Betting Explained" article, published on or before Jun. 9, 2009 and retrievd from URL <http://web.archive.org/web/20090609010433/http://www.sportingindex.com/extra-spread/guide/horse-racing-spread-betting.htm>, 4 pages.*

"Basics of Drag Racing: Handicap Racing" article, published on or before Jun. 16, 2009 and retrieved from URL <http://web.archive.org/web/20090616235234/http://www.nhra.com/nhra101/handicap.aspx>, 1 page.*

* cited by examiner

*Primary Examiner* — Dmitry Suhol
*Assistant Examiner* — Jason Skaarup
(74) *Attorney, Agent, or Firm* — Wood, Phillips, Katz, Clark & Mortimer

(57) ABSTRACT

A wagering system has a processor through which information regarding a plurality of competing contestants in a horse or dog race is made available to entities betting on the outcome of the race to seek a payout from a wagering pool. The information for at least one of the competing contestants is prepared based upon selected handicapping criteria to give the at least one of the competing contestants a time adjusted race identity. An input is provided for wagers to be placed on the race. The outcome of the race for wagering purposes is determined using the time adjusted race identity for the at least one of the competing contestants.

21 Claims, 1 Drawing Sheet

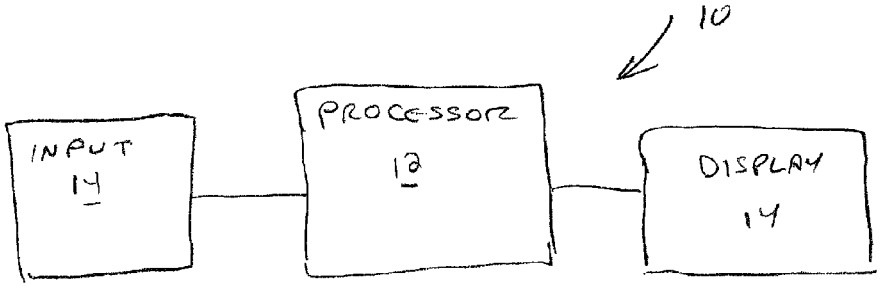
FIG 1
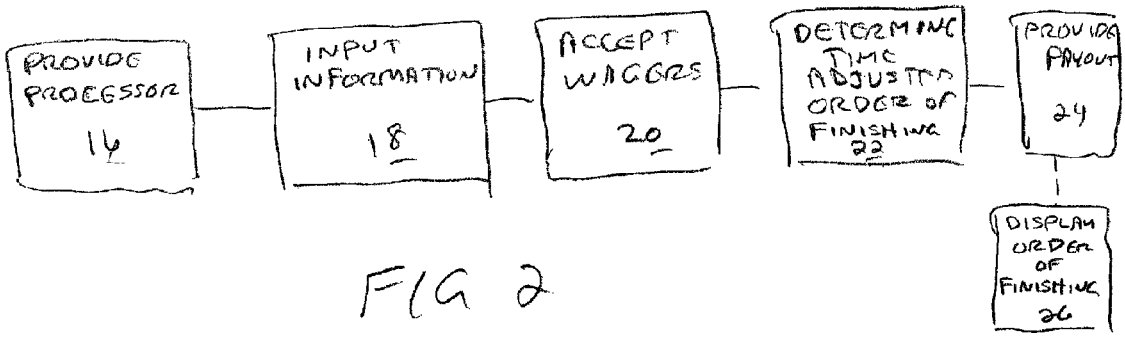
FIG 2
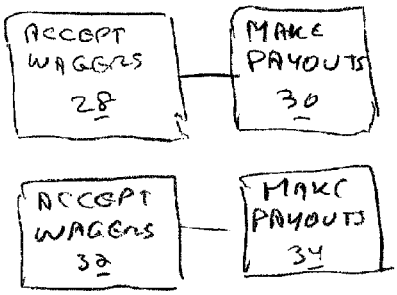
FIG 3
FIG 4
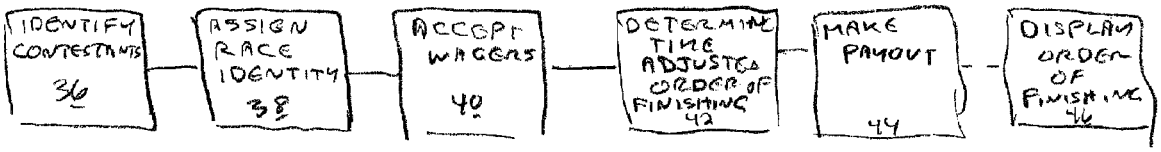

WAGERING SYSTEM AND METHOD OF WAGERING

BACKGROUND OF THE INVENTION

1. Field of the Invention

This invention relates to wagering and, more particularly, to a wagering system and method of wagering wherein the outcome of a race, for wagering purposes, is determined based upon comparing contestants amongst which at least one of the contestants has a time adjusted race identity based upon selected handicapping criteria.

2. Background Art

Horse racing (greyhound and quarter horse racing also) has been in decline for decades in the United States. Newer forms of gaming (casinos) have largely replaced racing as the number one gambling pastime. Racing is a slower paced activity in that wagers are spread out over a longer period of time. Casino gambling is far faster paced and the application of knowledge and skill to the games being played is simple and fast. In contrast, racing requires a player, if he/she wants a reasonable chance of success, to acquire a vast reservoir of knowledge and then apply that knowledge to the past performance publication for the race in question. This application is also time consuming. Thus, racing grew up as a slower paced gambling product. Current simulcasting of many races may seem to speed up the pace, but handicapping a race takes time and even if one has 5-10 races to play in 20-30 minutes, the good horse player can't process each race fast enough. Overnight study helps but factors present at the time of the race (track condition, track bias, weather) remain available only at post time. Additionally, "overnight study" may not be attractive to today's younger gambler. But a new generation gambler betting into racing pools taking 18-35% commissions on each bet appear doomed to lose big and can't hope to compete with expert handicappers taking the time to do the necessary homework. Thus, these new people gave up or never started going to the racetrack. Hence, the decline of racing occurred. Casinos, while being faster—20 bets per minute—also have commissions ranging from less than 1% to 3-5% on many bets.

The inventor herein devised a wagering system format as set forth in U.S. Pat. Nos. 5,888,136 and 6,152,822 to bet the races in a slot machine format. The purpose was to put novice horse players on an even footing with experts, increase the speed of play, unburden the player from the need to acquire handicapping skills, and remove the long time period necessary to handicap a race.

A primary element in the solution to bring racing into a competitive condition with casinos is to increase the speed of play while reducing commissions and at the same time making long periods of studying past performance unnecessary.

For much of the 20$^{th}$ century baseball was the main sports betting game in the United States. While not pari-mutuel, the baseball betting line was expressed similarly to horse racing odds. The two teams may be even money, or one team a 2-1 favorite. Typically, the Yankees might be 180 over the White Sox. A Yankee bettor would put up $180 to win $100 while a White Sox bettor would put up $100 to win $170. The $10 difference being the bookmaker "edge." This form of gambling is called "money line wagering."

During World War II the story is, a Chicago bookmaker—nicknamed the "Wizard of Odds"—devised the point spread. For several reasons (not germane here) baseball does not lend itself very well to point spread betting, though it is used today on occasion in combination with a money line. Yet football and basketball do lend themselves spectacularly to point spread wagering. In fact, so much so, they have greatly eclipsed baseball in popularity in both Las Vegas and underground wagering. The point spread effect is essentially this—it matters very little for 99% of the people betting which side they bet. The Bears +6½ points or the Saints −6½ points—either bet is mostly the same. The event can go either way. One percent or less of the players are so expert that the side picked does matter. For example, on a Sunday with fourteen games going on maybe one or two will matter to the experts. The other 12-13 games really are a 50-50 proposition.

One racing format developed to spur additional interest in horse racing is what is referred to as European "spread betting" on horse races, also called "winning distance index." European spread betting does use lengths won by or head or neck or multiple lengths (not time), but it is fixed odds wagering and does not involve time handicaps. It also does not involve placing results of all the horses but is offered by bookies as a proposition bet whereby a bettor can win more if his horse wins by progressively wider distances. By its nature it is complex and can only match up horse versus horse or horse versus winning margin, and its odds payoff while varying as to how far a winner wins by is predetermined (fixed odds) before the contest.

The industry continues to seek out racing formats to make betting on horse and dog racing more attractive to the overall betting population, and particularly those less inclined to spend the time and effort to understand the nuances of informed betting.

SUMMARY OF THE INVENTION

In one form, the invention is directed to a wagering system including a processor through which information regarding a plurality of competing contestants in a horse or dog race is made available to entities betting on the outcome of the race to seek a payout from a first wagering pool. The information for at least one of the competing contestants is prepared based upon selected handicapping criteria to give the at least one of the competing contestants a time adjusted race identity and an input for wagers to be placed on the race. The outcome of the race for wagering purposes is determined using the time adjusted race identity for the at least one of the competing contestants.

In one form, at least one of the plurality of competing contestants has a first unadjusted race identity. Those competing contestants in the plurality of competing contestants that do not have the first unadjusted race identity have a time adjusted race identity that is determined based upon the selected handicapping criteria to make all of the competing contestants in the plurality of competing contestants substantially equally likely to win the race for wagering purposes.

In one form, the criteria include at least one of: past race performance; weather conditions; jockey or driver; trainer; and post position.

In one form, the wagering system further includes a display upon which the outcome of the race for wagering purposes is visually identifiable for betting entities following the race.

In one form, the processor is configured to accept data relative to finishing times in the race for each of the plurality of competing contestants and use the data to determine the outcome of the race for wagering purposes.

In one form, the outcome of the race for wagering purposes is identified as the calculated order of finishing for each of the plurality of contestants. The finishing order for the at least one competing contestant for wagering purposes is determined by using an adjusted finishing time calculated for the at least one of the competing contestants using an actual finishing time adjusted by a time increment for the at least one of the contestants based upon the selected handicapping criteria.

In one form, each of a plurality of the competing contestants has an adjusted finishing time, and the adjusted finishing times are compared to identify the order of finishing for wagering purposes for each of the plurality of contestants.

In one form, at least one of the plurality of competing contestants has a first unadjusted race identity with an unadjusted finishing time. The adjusted and unadjusted finishing times are compared to identify the order of finishing for wagering purposes for each of the plurality of contestants.

In one form, the invention further consists of method of wagering comprising: providing a processor through which information regarding a plurality of competing contestants in a race is made available to entities betting on the outcome of the race to seek a payout from a first wagering pool, inputting information to the processor relative to the competing contestants prepared based upon selected handicapping criteria to give each of the competing contestants either a time adjusted race identity or an unadjusted race identity, the time adjusted race identity for each competing contestant correlated to an adjusted finishing time at the end of the race calculated using an actual finishing time adjusted by a time increment based upon the selected handicapping criteria; accepting wagers from entities betting on particular outcomes of the race; after the race is concluded, determining a time adjusted order of finishing for wagering purposes for each of the competing contestants by comparing the time adjusted finishing times with actual finishing times for any of the competing contestants that have an unadjusted race identity; and making a payout from the first wagering pool to entities betting on the outcome of the race based upon the time adjusted order of finishing for each of the competing contestants.

In one form, the method of wagering further includes the step of displaying the time adjusted order of finishing for each of the competing contestants.

In one form, the method of wagering further includes the step of accepting additional wagers and providing additional payouts based on the outcome of the race using a second format that is different than a first format for determining payouts and without using a time adjusted race identity for any of the competing contestants.

In one form, the race is a horse or dog race and the step of inputting information to the processor includes inputting information prepared based upon selected handicapping criteria that is at least one of: past race performance; weather conditions; jockey or driver; trainer; and post position.

In one form, the race is a horse or dog race.

In one form, at least one of the plurality of competing contestants has a first unadjusted race identity. Those competing contestants in the plurality of competing contestants that do not have the first unadjusted race identity have a time adjusted race identity that is determined based upon the selected criteria to make all of the competing contestants in the plurality of competing contestants substantially equally likely to win the race for wagering purposes.

In one form, the first and second formats provide payouts from the first wagering pool.

In one form, the first and second formats provide payouts from separate wagering pools.

In one form, the invention is still further directed to a method of wagering including: identifying a plurality of competing contestants in a race; based upon selected handicapping criteria, giving each of the competing contestants either a time adjusted race identity or an unadjusted race identity, the time adjusted race identity for each competing contestant correlated to an adjusted finishing time at the end of the race calculated using an actual finishing time adjusted by a time increment based upon the selected handicapping criteria; accepting wagers from entities betting on particular outcomes of the race; determining a time adjusted order of finishing for each of the competing contestants by comparing the time adjusted finishing times with actual finishing times for any of the competing contestants that have an unadjusted race identity; and making a payout from a wagering pool to entities betting on the outcome of the race based upon the time adjusted order of finishing for each of the competing contestants.

In one form, the method of wagering includes the step of displaying the time adjusted order of finishing for each of the competing contestants.

In one form, the method of wagering includes the step of accepting additional wagers and providing additional payouts based on the outcome of the race using a second format that is different than a first format for determining payouts and without using a time adjusted race identity for any of the competing contestants.

In one form, the race is a horse or dog race and the step of inputting information to the processor includes inputting information prepared based upon selected handicapping criteria that is at least one of: past race performance; weather conditions; jockey or driver; trainer; and post position.

In one form, the invention further consists of method of wagering comprising the steps of: providing a processor through which information regarding a plurality of competing contestants in a race is made available to entities betting on the outcome of the race to seek a payout; inputting information to the processor relative to at least one competing contestant prepared based upon selected handicapping criteria to give the at least one competing contestant a time adjusted race identity, the time adjusted race identity for the at least one competing contestant correlated to an adjusted finishing time at the end of the race calculated using an actual finishing time adjusted by a time increment based upon the selected handicapping criteria; accepting wagers from entities betting on particular outcomes of the race; and after the race is concluded making a payout to an entity that places a wager that identifies separate finishing orders utilizing both: a) the actual finishing time for the at least one competing contestant; and b) the adjusted finishing time for the at least one competing contestant.

By importing the football and wagering model into horse and dog racing, many of the problems that have caused interest therein to stagnate or decline would be addressed. The novice player may be put on nearly equal footing with an expert. Play becomes very fast. Simulcasting will then benefit racing as many decent chance bets can be made quickly without excessive study time needed. Do all this into . . . hopefully lowered commissions 10-11% perhaps . . . and racing could be revitalized. The younger players want party time when gambling—not a studious, laborious application of handicapping principals applied slowly and carefully to each race offered. An eight horse field where the 1 is 3-5 and wins 55-60% of the time would be replaced by eight horses, ranging in odds from 4-1 to 9-1. And all might have pretty decent chances to win. Expert handicappers have not been abandoned, as now they can pit their knowledge against the track handicapper who made the time handicap morning line. Also, their expertise applied to multiple pool bets will still stand them in good stead versus the novice players. But the novice will still be on 97% equal footing. Now he/she has only a slim hope of being successful without applying the traditional handicapping skills he/she doesn't have and is not inclined to learn.

Time spread betting (hereinafter "Time Spread Betting") sets a time handicap for each horse in the race—the race is run—all horses contesting the race are timed. The time handicaps are then applied with the then adjusted times determining the final order of finish for wagering purposes of that specific pool. It doesn't matter if a horse prevails by $1/100^{th}$ second or 2 seconds, its placing is the same. Then the pari-mutuel pools accumulated during the wagering period (during which the bettors placed bets being aware of time handicaps to be applied) determine the final odds on any given horse. Should that horse prevail after time handicaps are applied, all bettors selecting that horse win. This has no effect on purse distribution—only the raw time finish applies to that process and time handicaps effect on the payoffs of any other non-time spread wagering pool.

BRIEF DESCRIPTION OF THE DRAWINGS

FIG. 1 is a schematic representation of a wagering system according to the present invention;

FIG. 2 is a flow diagram representation of one method of wagering, according to the invention;

FIG. 3 is a flow diagram form showing a hybrid wagering method including the wagering method in FIG. 2; and FIG. 4 is a flow diagram representation of a modified form of a method of wagering, according to the invention.

DETAILED DESCRIPTION OF THE PREFERRED EMBODIMENT

A wagering system, according to the present invention, is shown at 10 in FIG. 1. The wagering system has a processor 12 through which information regarding a plurality of competing contestants in a horse or dog race is made available to entities betting on the outcome of the race to seek a payout from a first wagering pool. As explained in greater detail below, the information for at least one of the competing contestants is prepared based upon selected handicapping criteria to give the at least one of the competing contestants a time adjusted race identity, for wagering purposes, as determined using the time adjusted race identity for the at least one of the competing contestants.

An input 14, which may be configured for manual or electronic operation, allows wagers to be placed on the race.

At least one of the plurality of competing contestants has a first unadjusted race identity. Those competing contestants that do not have the first unadjusted race identity have a time adjusted race identity that is determined based upon selected handicapping criteria to make all of the competing contestants in the plurality of competing contestants substantially equally likely to win the race for wagering purposes.

The track handicapper will study each upcoming race and assign a zero time handicap to the contestant (such as a horse) most likely to win the race, in his opinion. (He/she can, if he/she wishes, assign more than one horse the same handicap.) This horse will maintain the unadjusted identity for the race. He/she then assigns a minus time handicap to each other horse in the race that maintain a time adjusted identity for the race. The theoretical goal, taking in at least one, and preferably a plurality of factors such as form, post race performance, weather, jockey or driver, trainer, post position, etc., is to bring all horses in the race to a "time adjusted" eight horse dead heat (assuming eight horses in the race). Such a race could look as follows:

Harness Race With 8 Horse Field

| Horse | Advantage in Time | Approx. Equivalent Advantage in Distance |
|---|---|---|
| #1 | −0.08 second | ½ length |
| #2 | 0 | 0 |
| #3 | −0.75 second | 4 lengths |
| #4 | −0.13 second | ¾ length |
| #5 | −0.14 second | ¾ length |
| #6 | −0.37 second | 2 lengths |
| #7 | −0.94 second | 5 lengths |
| #8 | −1.32 second | 7 lengths |

The race is run. Perhaps, to keep all horses competing beyond fifth place, 7 or 8 places should be paid with purse money instead of the customary first 5 finishers. Purse money and any conventional pool betting would be determined by the raw time finish. Only this special pool bet—be it win, perfecta, trifecta, etc.—would be determined by the adjusted time finishes using the adjusted race identities and at least one unadjusted race identity. In harness racing a base time of 1:55 ⅕ for a mile and one horse length being about 8⅓ foot are taken into account. In thoroughbred racing, a table of time with approximate distances following, as per the above table, is based on a base time of 1:36.0 for a mile and one horse length being 8⅓ foot. Since time is the deciding factor, and all races are now timed (each horse) to $1/100^{th}$ of a second, this is the only calculating factor. An approximate equivalent distance chart accompanies each time handicap simply to help the patron to visualize the size of each horse's handicap.

TIME/DISTANCE CHARTS

| HARNESS Based on 1:54 mile time (1 length (8⅓ ft.) = .18 sec) (0.01 second = 5.56 inches) | | THOROUGHBRED Based on 1:36 mile time (1 length (8⅓ ft.) = .15 sec) (0.01 second = 6.67 inches) | |
|---|---|---|---|
| Distance Behind/Ahead | Time In Seconds | Distance Behind/Ahead | Time in Seconds |
| Nose | 0.01 | Nose | 0.01 |
| Head | 0.02 | Head | 0.02 |
| Neck (¼ Length) | 0.04-0.05 | Neck (¼ Length) | 0.03-.0.04 |
| ½ Lengths | 0.08-0.09 | ½ Lengths | 0.07-0.08 |
| ¾ Lengths | 0.17-0.14 | ¾ Lengths | 0.11-0.12 |
| 1 Lengths | 0.18-0.19 | 1 Lengths | 0.15-0.16 |
| 1¼ Lengths | 0.22-0.23 | 1¼ Lengths | 0.19 |
| 1½ Lengths | 0.28-0.29 | 1½Lengths | 0.23 |
| 1¾ Lengths | 0.32-0.33 | 1¾ Lengths | 0.27 |
| 2 Lengths | 0.37-0.38 | 2 Lengths | 0.31 |
| 3 Lengths | 0.56-0.57 | 3 Lengths | 0.46-0.47 |
| 4 Lengths | 0.75-0.76 | 4 Lengths | 0.62 |
| 5 Lengths | 0.93-0.95 | 5 Lengths | |
| 6 Lengths | 1.12-1.14 | 6 Lengths | |
| 7 Lengths | 1.31-1.33 | 7 Lengths | |
| 8 Lengths | 1.49-1.52 | 8 Lengths | 1.23-1.24 |
| 9 Lengths | 1.68-1.71 | 9 Lengths | |
| 10 Lengths | 1.86-1.90 | 10 Lengths | |
| 11 Lengths | 2.05-2.09 | 11 Lengths | |
| 12 Lengths | 2.24-2.28 | 12 Lengths | |
| 13 Lengths | 2.42-2.47 | 13 Lengths | |
| 14 Lengths | 2.61-2.66 | 14 Lengths | |
| 15 Lengths | 2.79-2.85 | 15 Lengths | |
| 16 Lengths | 2.97-3.03 | 16 Lengths | 2.47-2.48 |

-continued

| TIME/DISTANCE CHARTS | | | |
|---|---|---|---|
| QUARTER HORSES<br>Based on 21.4 sec quarter mile<br>(1 length (8⅓ ft.) = .135 sec)<br>(0.01 second = 7.41 inches) | | GREYHOUNDS<br>Based on 24.5 sec quarter mile<br>1 length (3½ ft.) = .065 sec<br>(0.01 second = 6.46 inches) | |
| Distance Behind/Ahead | Time in Seconds | Distance Behind/Ahead | Time in Seconds |
| Nose | 0.01 | Nose | 0.01 |
| Head | 0.02 | Head | 0.01 |
| Neck (¼ L) | 0.04 | Neck (¼ L) | 0.02 |
| ½ Lengths | 0.07 | ½ Lengths | 0.03-0.04 |
| ¾ Lengths | 0.10 | ¾ Lengths | 0.05 |
| 1 Lengths | 0.13-0.14 | 1 Lengths | 0.06-0.07 |
| 1¼ Lengths | 0.17 | 1¼ Length | 0.08 |
| 1½ Lengths | 0.20 | 1½ Lengths | 0.10 |
| 1¾ Lengths | 0.24 | 1¾ Lengths | 0.11 |
| 2 Lengths | 0.27 | 2 Lengths | 0.13 |

The processor 12 is configured to accept data relative to actual finishing times in the race for each of the competing contestants and use the data to determine the outcome of the race for wagering purposes. As explained above, each of the competing contestants, with the exception of the one or more contestants that has an unadjusted race identity, has an adjusted finishing time based upon the selected handicapping criteria. These adjusted finishing times are compared to the actual finishing time for the contestant(s) with the unadjusted race identity to identify the order of finishing for wagering purposes for each of the contestants in the race. That is, the finishing order for at least one of the competing contestants, for wagering purposes, is determined by using an adjusted finishing time calculated starting with an actual finishing time that is adjusted by a time increment based upon the selected handicapping criteria.

The wagering system 10 further has a display 14 upon which the outcome of the race, for wagering purposes, is visually identifiable for betting entities following the race.

In FIG. 2, a method of wagering, according to the present invention, is shown in flow diagram form. As shown at block 16, a processor is provided through which information regarding a plurality of competing contestants in a race is made available to entities betting on the outcome of the race to seek a payout from a first wagering pool.

As shown at block 18, information is input to the processor relative to the competing contestants prepared based upon selected handicapping criteria to give each of the competing contestants either a time adjusted race identity or an unadjusted race identity. The time adjusted race identity for each competing contestant is correlated to an adjusted finishing time at the end of the race calculated using an actual finishing time adjusted by a time increment based upon the selected handicapping criteria.

As shown at block 20, wagers are accepted from entities betting on particular outcomes of the race.

As shown at block 22, after the race is concluded, a time adjusted order of finishing is determined for wagering purposes for each of the competing contestants by comparing the time adjusted finishing times with actual finishing times for any of the competing contestants that have an unadjusted race identity.

As shown at block 24, a payout is made from the first wagering pool to entities betting on the outcome of the race based upon the time adjusted order of finishing for each of the competing contestants.

As shown at block 26, optionally the time adjusted order of finishing is displayed for each of the competing contestants, as on a monitor, or through electric transmission to a receiver upon which the information can be observed.

The method, depicted in FIG. 2, is one that utilizes a system as shown at 10 in FIG. 1, or another type of system.

As shown in FIG. 3, the invention further contemplates that different wagering formats may be utilized, allowing bettors to make wagers in the same race with potentially different outcomes. As shown in FIG. 3, at block 28, wagers are accepted and payouts made as shown at block 30 in accordance with the aforementioned method depicted in FIG. 2. In parallel with this, wagers can be accepted, as shown at block 32 and payouts made as shown at block 34 using a different format for determining race outcome, be it actual or another variation.

The first and second formats may derive payouts from the same or separate wagering pools. The percentage payouts may vary as explained further below.

Another method wagering, according to the present invention, is shown in flow diagram form in FIG. 4. As shown at block 36, a plurality of competing contestants in a race are identified.

As shown at block 38, based upon selected handicapping criteria, each of the competing contestants is assigned either a time adjusted race identity or an unadjusted race identity. The time adjusted race identity is correlated to an adjusted finishing time at the end of the race calculated using an actual finishing time adjusted by a time increment based upon the selected handicapping criteria.

As shown at block 40, wagers are accepted from entities betting on particular outcomes of the race.

As shown at block 42, a time adjusted order of finishing is determined for each of the competing contestants by comparing the time adjusted finishing times with actual finishing times for any of the competing contestants that have an unadjusted race identity.

As shown at block 44, payouts are made from a wagering pool to entities betting on the outcome of the race based upon the time adjusted order of finishing for each of the competing contestants.

Optionally, as shown at block 46, the time adjusted order of finishing for each of the competing contestants may be displayed for visual observation.

The method in FIG. 4 may likewise use a system 10 as in FIG. 1 or an alternative form of system.

The format for accepting wagers and making payouts based upon the outcome of a race, as in FIG. 4, may be used in parallel with another format, as shown in FIG. 3 for the method in FIG. 2.

By constructing a time handicapped race many things are potentially accomplished—especially for harness racing on ½ mile and ⅝ mile tracks—but effective for all pari-mutuel racing on any track.

There are attractive odds (usually) on all horses in the race. Instead of having a usual heavy favorite from an inside post position that wins half or more of the time, a field of balanced odds is created; all horses offering good wagering odds (probably all horses will go off between 4-1 and 9-1 odds). The time handicaps level the playing field, making most any result equally likely. Novice bettors are now on near equal footing with older expert handicappers. Betting a race is made into essentially a "live slot machine"—which does not require much skill or time studying to handicap.

The handicapping factor is greatly reduced. This is essential in attracting "new blood" to racing. Yet expert handicappers still get to pit their skills against the track handicapper who makes the handicap line. Their superior knowledge and skills in wagering into the quirky pari-mutuel system will still provide them with some residual advantage. An example would be wagering into a described bet (later detailed herein) such as the twin-win, twin-perfecta, etc. Also, these experts will be able to use Time Spread Betting as a "hedge" bet to bets made into the conventional pools. As a short explanation, an astute bettor can lock in profits and "middle" (win both bets or if not winning both, one bet decreases the risk of the other . . . something analogous to buying stocks and selling options or selling stocks and buying options.) It is possible to win both sides at times. This aspect takes expert knowledge.

Commissions may be reduced. This applied to Time Spread Betting would potentially prove highly successful as now these "live slot machine"-like bets could compete with the actual slot machine commissions. Commissions of 10-12% could work very profitably for the pari-mutuel industry because those take outs (10-12%) are about what the hot Vegas penny slots take out.

Play is speeded up. By de-emphasizing handicapping, speed of play is greatly enhanced and it becomes possible for bettors to effectively play many simulcast races very quickly. This, in combination with reduced take out rate would greatly expand volume of pari-mutuel handle, potentially leading to economic success.

Time Spread Betting would require certain regulatory "adjustments" by the officials. Should a horse, in the conduct of a race, do something that requires disqualification, then that horse would be disqualified and the judges would place that horse behind some other horse in the race, or last, as they so judge, just as they currently do. For the placing of horses in Time Spread Betting, one possibility is that the offending horse be given a time $1/100^{th}$ of a second behind that horse's time that the offending horse has been placed behind.

It is possible that a horse might be disqualified and placed behind a horse yet still, because of its time handicap, win or be second etc. as to placing in Time Spread Betting. However, purse considerations will always be the placed results of the judges as to the conventional pools.

There will be many more dead heats in Time Spread Betting, as $1/100^{th}$ of a second is about 5½ inches in harness (6.6 inches in thoroughbreds). This is no problem as dead heats easily fit into the pari-mutuel payout system. The rare case when two or more horses are assigned the exact same time handicap in a Time Spread Betting race and they finish close together where they are involved in a photo finish in the conventional race pool for purse or wagering purposes . . . then, in that case (finishing 5-7 inches apart) for wagering purposes in the Time Spread Betting pool, the horse might be placed ahead that actually was ahead in the conventional photo finish photo—even though both horses are timed identically to within $1/100^{th}$ of a second. But this is now done routinely anyway in all conventional wagering and a photo would be produced anyway for the conventional race to be used for a more exact placing.

Special wagering is available with Time Spread Betting. Casinos offer "bonus rounds" on slots and side bets on table games. To compete, the following examples might be available with Time Spread Betting. Of course, Win-Per-Trifecta and perhaps even Superfecta and Hi five versions could be offered as well as other possible bets. But other attractions could be developed that would continue the de-emphasis on handicapping allowing novices near equal footing with expert handicappers.

Twin Win Betting, version A, can be of two types: 100% carryover; and 50-75% carryover with balance paid as consolation. (Or perhaps alternatively 75% carried over and 25% paid to those tickets selecting either the winner of the conventional win pool, or the winner of the Time Spread Betting win pool.) Version B may involve one type only. Also similarly, twin perfecta wagering or twin trifecta wagering, etc.

In casinos, both table games and slots have an extra "element". Table games have "side bets", while slots have "Bonus Rounds." Because "Time Spread Betting" is, in a very real way, an analogous method of wagering to slots especially and to table games partially (less intensive thinking), more chance than a studied skill like handicapping, there is need for an extra "element"—such as "Twin Win Betting". It works as follows: as an example with a win pool for Time Spread Betting on the $6^{th}$ race. A Twin Win Pool is run on the $6^{th}$ race. For Time Spread Betting numbers 1, 2, 3, 4, 5, 6, 7, 8 are offered, all with a time handicap subtracted from the horses' final time, except the "scratch horse" that runs without any time subtraction. (It should be said Twin Win Betting will likely debut down the road a bit after bettors, hopefully, take to Time Spread Betting. Second generation "add-ons" might be Perfectas and Trifectas, Twin Win, Twin Perfecta, Twin Trifecta, etc.)

Twin Win Tickets (1-1, 2-2, 3-3, 4-4, 5-5, 6-6, 7-7, 8-8) could also be offered—a mere eight possible tickets. But to cash the bettor would have to select the winner of the Time Spread Betting pool and the winner of the conventional win pool. And, of course, they would have to be the same horse. Most of the time (87½%) this would not happen and the entire Twin Pin pool would carry over. (Or perhaps ½ to ¾ would carry over with balance paid to tickets that had either the time spread winner or the conventional race winner.) This is a "side bet" or "Bonus Round".

In Time Spread Betting the conventional betting favorite horse will have many more conventional wins than he/she will have Time Spread "covers". Conversely, in Time Spread Betting the conventional betting longest shot horse in the conventional win pool will have very few wins but many more covers in the Time Spread pool. So in the Twin Win carryover we will see, at exemplary Maywood track for example, many 1-1's, 1-2's, 1-3's, 1-4's, 1-5's, 1-6's, 1-7's, 1-8's, but far fewer 8-5's, 8-6's, 8-7's, 8-8's. Overall, more favorites than longshots in the Twin Win when it hits (keeping in mind, only 1-1 would hit the carryover Type A), but still much higher odds than any ordinary two horse bet (double, perfecta), and needing the same horse winning both pools or carryover will result in very high odds for this rich paying Bonus Bet/Side Bet.

Anyone may bet into any pool. Casinos usually let persons place side bets at table games without wagering on the regular bet . . . though not always. Slots do require regular bets to participate in Bonus Rounds.

Another way to offer Twin Win Betting could be to offer combinations. (For example: 1-1, 2-1, 3-1, 4-1; 1-2, 2-2, 3-2, 4-2; 1-3, 2-3, 3-3, 4-3; 1-4; 2-4; 3-4; 4-4; etc.) One option is a 64 possible twin win. The winner could be paid as any perfecta but if no "doubles" hit (1-1, 2-2, 3-3, 4-4, 5-5, 6-6, 7-7, 8-8), possibly 25% of pool would be carried over until there is a twin win. Payoffs on twin perfecta or twin trifectas could result in a very large carryover.

Dead heats may be determined by the times—not photo—for time spread pool only and its pari-mutuel payouts. (The conventional pool will have its placing for purse and pari-mutuel payouts determined by the photo—not the time.) Because a harness horse travels about 5½ inches in $1/100^{th}$ of a second . . . there will be more dead heats for Win (or Pers $2^{nd}$ or Tris $3^{rd}$) because, should horses be within 5 or so inches of each other in raw or "adjusted time", they will be (could be) awarded the same adjusted times. One solution is to pay multiple winners.

There is no need for the judges to concern themselves about disqualifications. The horse could be placed in the conventional race result where they believe he/she should be placed. But then we must award an official adjusted time for that placed back horse. That time should be $1/100^{th}$ second behind the horse's raw time that the disqualified horse is placed behind. (It would always be slower than the actual raw time the offending horse actually ran.) Then any time handicap applicable can be applied to the offending horse's new (judges') raw time. This would then be the time the offending horse ends up with for betting purposes in the Time Spread race. The official order of finish for purse and conventional/raw place would be behind the horse judges place it at in the conventional race.

One example can be explained in a conventional win pool also having Time Spread win pool. Horse #1 wins, but interfered with horse #4. In the conventional win pool, #1 finished first and #4 finished third. Judges new placing is:

#2 (who was $2^{nd}$)—raw time 1:58:26—$1^{st}$ place
#4 (who was $3^{rd}$)—raw time 1:58:40—$2^{nd}$ place
#1 (who was $1^{st}$)—raw time 1:58:03 disallowed—$3^{rd}$ place
(1:58:41 new official raw time for TSB wagering purposes)

Now apply handicaps:

#2 1:58.26−0.05=1:58.21
#4 1:58:40−0.36=1:58.04
#1 1:58:41−0.21=1:58.20

Official Time Spread placing: #4—$1^{st}$, #1—$2^{nd}$, #2, 3rd
Pay 7 of 8 places (to keep efforts up)
Regular 8 horse field—$4000
$1^{st}$—$2000
$2^{nd}$—$1000
$3^{rd}$—$480
$4^{th}$—$320
$5^{th}$—$200
Time Spread—$4000
$1^{st}$—$1950
$2^{nd}$—$950
$3^{rd}$—$450
$4^{th}$—$300

The inventor herein published separate articles on certain aspects of the invention. More specifically, two articles were published in the November 2009 and December 2009 publication *Mid-America Standardbred and Harness News* and a third unpublished article was submitted with provisional application No. 61/394,666 (the priority application hereto). The substance of each of those articles is reproduced below.

Football Season . . . take the points? Lay the points? Hey, it doesn't matter. Basically you will win about half your bets . . . and lose half. You lay 11-10 so you end up losing, but a lot of entertainment . . . for your approximately 5% loss over time. And you really don't need to handicap the teams. Too bad you can't do that with horse racing. Or can you? More correctly will you? If Balmoral/Maywood likes the idea shortly you will. Here is how it will go. Take a win bet at Maywood on a Thursday night perhaps.

#1 Handicap—0.09 second
#2 Handicap—0 (the scratch horse)
#3 Handicap—0.16 second
#4 Handicap—0.20 second
#5 Handicap—0.28 second
#6 Handicap—0.39 second
#7 Handicap —0.48 second
#8 Handicap—0.69 second (Harness horses going 1:54 mile cover a length in 0.18 seconds. A length is about 8⅓ feet. A 1:54 miles is 114 seconds. Divide 114 by 0.18 32 633⅓×8⅓ feet=5277.78 feet. Close enough to 5280 feet.) Now bet into the WIN pool. Use your program to handicap . . . or just stab one. IF . . . and this IF is the key, the track handicapper can make a good "time handicap" then the pari-mutuel odds might look like this;

Breakage 10 cents

| | Win Pool | Win Odds | $2 win |
|---|---|---|---|
| #1 | 1,980 | 5-1 | $13.30 |
| #2 | 2,430 | 4-1 | $10.90 |
| #3 | 2,060 | 5-1 | $12.80 |
| #4 | 2,100 | 5-1 | $12.60 |
| #5 | 1,908 | 5-1 | $13.80 |
| #6 | 1,877 | 6-1 | $14.10 |
| #7 | 1,799 | 6-1 | $14.70 |
| #8 | 2,014 | 5-1 | $13.10 |
| | $16,168 | | |
| | 18% commission ($2,910.24) | | |
| | Net Pool = $13,257.76 | | |

Because we are pari-mutuel all odds won't be the same as Football lines (11-10) but subject to the bettors opinions we could get a final odds as above or if the track handicapper is off . . . there could be a more normal board. But the idea is to level the handicapping field by having the track handicapper even the field. The track must record time to the 100th second . . . for each and every horse. The "corrected time finish" is posted subtracting the handicap from each horse's actual time. Fastest placed first, next fastest second, etc. Sometimes dead heats. Eventually after the public is used to this and likes it. Perfectas and trifectas. I call it "Length Spread Betting". The program should show an information chart that gives approximate lengths a time handicap represents. 0.18 sec.=1 length (8/13 feet at a 1:54 pace). But time decides the winner. This pool can be offered alongside traditional pools, if allowed, experimenting with a reduced takeout in this pool as well as the conventional win pool should be tried. More to come. "Did Your Horse Cover?" by Richard A. Herbert, M D (*Mid-America Standardbred & Harness News*—November 2009).

Bringing "point spread betting" to racing is an attempt to provide racing with a wager that, while completely conventional in pari-mutuel structure, creates a level playing field between form handicappers and a younger generation racing has nearly completely lost. But to succeed it needs some help from the powers that be. We need a bet that a customer can make and be at pretty even chance with everyone else. But we can't forget our horse players either. This is it.

While their advantage in reading a form seems less important—maybe they too will find a niche in this type of a bet. Let's look at an ordinary race with ordinary betting. Perhaps a good horse draws the rail and likes the front. In ordinary racing he might go off 4-5. But with "L.S.B." he might be spotting the other seven horses in the race from 0.13 seconds (approximately ¾ length) to 1.19 seconds (approximately 6½ lengths). Under the conditions he may only draw 10 or so percent of the total win pool and go off at odds of 7-1 and pay $16.40. True, to cash he must overcome the "weight"—lengths—all calculated in time handicaps. But every week in the NFL the best teams are handicapped by up to 14-15-16 points—and they only pay 10-11 odds! Here we can take advantage of what once gave racing the advantage in gambling—odds. We need to get the payoffs up—yet still offer our old handicappers something to shoot for. Our new bettor will be happy with a bunch of "appetizing" possible wagers—and they won't have to handicap. They can spend their time partying, eating, drinking, slapping their girls on the—back and betting!

Now if you really want to launch this and get big pools, try this. All one horse wagers commission 12% (this will be win wagering). All two horse or race wagers (perfectas and doubles) 13%. All three horse or race wagers (trifectas and pick three) 14%. All four horse or race wagers (superfectas and pick four) 15%. All five horse or race wagers 16&. All six 17%, etc.

Keep the take low! Out compete the penny slot. Even though racing, even with simulcasting, is slower paced than slots, our bets are more: $1, & $2 mostly as well as larger players making $100, $1,000 bets! We have enough action and our bets—in this format—will allow for many new customers and our players will like to compete into these pools with them.

These races will be nearly fix proof. Anyone trying will have to recruit most of the field and even then would look ridiculous and get caught trying to orchestrate a timed handicap finish. Way too hard! They will step on their money or be so obvious they will be handcuffed in the paddock.

A couple of other things. Pay every place (except perhaps last) to keep all entries trying to the end. We don't want the appearance of not trying to taint the wagering. Then we need two or three or four excellent trip handicappers to make handicap lines then have them reconciled into one "official handicap." All types of racing can use this wagering form. Below is an example of a perfecta pool with a 13% commission.

| Perfecta Pool | | |
|---|---|---|
| 1-2 | | 788 |
| 1-3 | | 849 |
| 1-4 | Favorite | 1123 |
| 1-5 | | 886 |
| 1-6 | | 791 |
| 1-7 | | 910 |
| 1-8 | | 886 |
| 2-1 | | 850 |
| 2-3 | | 942 |
| 2-4 | | 1012 |
| 2-5 | | 899 |
| 2-6 | | 910 |
| 2-7 | | 745 |
| 2-8 | | 844 |
| 3-1 | | 1016 |
| 3-2 | | 884 |
| 3-4 | | 786 |
| 3-5 | | 814 |
| 3-6 | | 1012 |
| 3-7 | | 943 |
| 3-8 | | 925 |
| 4-1 | | 883 |
| 4-2 | | 781 |
| 4-3 | | 695 |
| 4-5 | Highest Odds | 688 |
| 4-6 | | 712 |
| 4-7 | | 810 |
| 4-8 | | 742 |
| 5-1 | | 745 |
| 5-2 | | 839 |
| 5-3 | | 1024 |
| 5-4 | | 769 |
| 5-6 | | 858 |
| 5-7 | | 914 |
| 5-8 | | 938 |
| 6-1 | | 767 |
| 6-2 | | 994 |

-continued

| Perfecta Pool | | |
|---|---|---|
| 6-3 | | 1045 |
| 6-4 | | 1020 |
| 6-5 | Win | 883 |
| 6-7 | | 754 |
| 6-8 | | 1042 |
| 7-1 | | 866 |
| 7-2 | | 945 |
| 7-3 | | 1015 |
| 7-4 | | 1048 |
| 7-5 | | 912 |
| 7-6 | | 949 |
| 7-8 | | 1015 |
| 8-1 | | 814 |
| 8-2 | | 785 |
| 8-3 | | 882 |
| 8-4 | | 1110 |
| 8-5 | | 894 |
| 8-6 | | 922 |
| 8-7 | | 1001 |

| Gross Pool: (10¢ Breakage) | |
|---|---|
| $49,876.00 | Total Gross Pool |
| −6,483.88 | 13% Commission |
| $43,392.12 | Net Pool Total |

| | Note: #4 in both lowest and highest perfecta payoffs. | Favorite Perfecta 1-4 | $2 Perfecta Odds 37-1 | $2 Perfecta $77.20 |
|---|---|---|---|---|
| Commission | $6,483.88 | Longshot Perfecta 4-5 | 62-1 | $126.10 |
| Breakage | $36.82 | | | |
| Return to Bettors: | $43,355.30 | Winning Perfecta 6-5 | 48-1 | $ 98.20 |

Of course, many races may have handicaps that don't cause such an even split of the wagering pool—but those races may be just as interesting to bet into. We just need a timer that does 1/100 of a second. Let us know your thoughts.

To answer some early feedback: It was pointed out that the public will not KNOW who won under the handicap system most of the time. Precisely correct! You can't look upon this bet from the traditional list horse player's viewpoint. I want all or most ticket holders to be in anticipation of the "final result." It will be like five or six different ticket holders "live in the photo." The new players will view this as normal as slot players are routinely "told" by the machine if they won or lost by the bells and whistles going off. And our horse players will see it as being "live in the photo." Anticipation is a good thing to produce when gambling. Don't worry about this—just try it "Length Spread Betting" by Richard A. Herbert, M D (*Mid-America Standardbred & Harness News*, December 2009).

A new name for Length Spread Betting was proposed by Maywood's Doc Narutsky. I like it, it is even more descriptive in that we handicap this wager via actual time—exact to $1/100^{th}$ of a second—rather than the "relative" concept of lengths (which vary in that faster horses cover any given distance quicker than slower horses). Answering some more questions and comments about Time Spread Betting. Paul Svendsen of Maywood, at a meeting in November raised an interesting though. He wondered if a bettor might feel a bit cheated when his horse covers the time handicap paying 6-1 for example, but also wins the race outright paying 22-1 for example in the conventional win pool. That brought me to the subject of this final article on the introduction of "T.S.B.".

I pointed out a couple of things. A horse, not the conventional favorite, will cover perhaps 4-10 times for each outright win he garners. Conversely, the conventional race favorite will outright win perhaps 4-10 times for each T.S.B. race he covers. In this statement one begins to see the purpose of T.S.B. We level the playing field between novices and experienced handicappers. The only purpose for T.S.B. that is designed into it. Sure a side effect might be that experienced handicappers might find value in many of the T.S.B. races and be able to get 5-1 on a 4-5 shot from the rail, or cash at 7-1 on a 40-1 conventional bet horse leaving from the eight hole.

I then revealed what I had in mind for one "cheated bettor." First, he was always free to wager something on "his horse" in the conventional pool. Many experienced sports bettors "hedge" by both wagering on their team at the point spread AND the "money line." Sometimes they even "double hedge" by betting both teams in a game—one taking the points—and the other laying no points but laying odds—say 2-1. For example, they may bet $50 to win $25 on team A (no points involved) while simultaneously wagering $55 to win $50 on team B getting 5 points. Should the game end with team A winning 21-17 they win both bets, plus $75. If team B should outright win the game they would lose $50 and win $50 breaking even while if team A blows out team B they would win $25 and lose $55, netting a minus $30. So the three possible results would be +$75, 0, −$30. Given proper conditions many astute sports bettors make a living hedging. Horse racing with 8-12 starters each race provide many more opportunities to hedge given T.S.B. One can certainly bet the "scratch horse" only in the conventional pool while betting a horse with a time handicap in the T.S.B. pool, cashing both bets while he hedges his bet on the favorite. So here we see while simultaneously "leveling the field" for the novices racing so desperately needs—we also open up a new avenue for the experienced handicapper to exploit. Since the track makes its end on the volume of money bet we have, with T.S.B., a win-win-win situation.

The final part I held back to now. I would also offer another sort of hedge for our "cheated bettor." I call it "Twin Win Betting." After T.S.B. is introduced I would offer this companion wager. It is like the Bonus Round in slots or the Side Bet in casino table games. It can be offered in two forms.

| Form [A] Twin Win-Win Bet | | 100% Carryover If Not Hit |
|---|---|---|
| offers tickets: | 1-1 | only 8 possible bets |
| | 2-2 | |
| | 3-3 | |
| | 4-4 | |
| | 5-5 | |
| | 6-6 | |
| | 7-7 | |
| | 8-8 | |

To win, you must pick one of these eight offered tickets (of course you can bet all eight if you like). Then if the very same horse is declared the winner of the conventional win pool and the T.S.B. win pool and you have those twin win numbers you hit the carryover. Much tougher proposition than it seems. For example, say the favorite wins 40% in the conventional pool. then in the T.S.B. he might win 13% of the time. This means (0.4)(0.13)=0.052—a bit over 5% the favorite might trigger the twin win. All the others combined might trigger it another 7-8%. So in total it will carry over 7-9 times on average before being hit.

| Form [B] Twin Win-Win Bet 20 = 50% Carryover If Not Hit | | | | | | | | |
|---|---|---|---|---|---|---|---|---|
| offers tickets: | 1-1 | 2-1 | 3-1 | 4-1 | 5-1 | 6-1 | 7-1 | 8-1 |
| | 1-2 | 2-2 | 3-2 | 4-2 | 5-2 | 6-2 | 7-2 | 8-2 |
| | 1-3 | 2-3 | 3-3 | 4-3 | 5-3 | 6-3 | 7-3 | 8-3 |
| | 1-4 | 2-4 | 3-4 | 4-4 | 5-4 | 6-4 | 7-4 | 8-4 |
| | 1-5 | 2-5 | 3-5 | 4-5 | 5-5 | 6-5 | 7-5 | 8-5 |
| | 1-6 | 2-6 | 3-6 | 4-6 | 5-6 | 6-6 | 7-6 | 8-6 |
| | 1-7 | 2-7 | 3-7 | 4-7 | 5-7 | 6-7 | 7-7 | 8-7 |
| | 1-8 | 2-8 | 3-8 | 4-8 | 5-8 | 6-8 | 7-8 | 8-8 |

To win you simply must pick the winner of the conventional win pool and the T.S.B. win pool. Should you have a ticket as in the boxes above, 1-1, 2-2, 3-3, 4-4, 5-5, 6-6, 7-7, or 8-8 AND those numbers win both win pools, you hit the carryover. If any other number wins, the pool divides as any pari-mutuel pool with 20-50% pulled and carried over until a twin win triggers.

I like form [A] best, but both will serve as a hedge for our skilled handicappers, or as a big jackpot to be handicapped for, or as a way to let novices in on the fun without being at great disadvantage to experienced players. This form of wagering does not even require the novice to Buy a program!

After a time T.S.B. perfectas and twin win perfectas should be introduced. The carryover here will be enormous as the chances of pairing say a conventional pool perfecta of 4-1 with the identical result of 4-1 in the T.S.B. pool will happen about once every hundred or more races. Go to trifectas, and over a couple of years, a pool could build up to pay $50,000,000 or more.

How do we launch these new bets? Start with prizes and use qualifiers and free buffets. Market it and publicize it so the public gets curious. When real betting starts give out free $1 vouchers (I would standardize this as a $1 bet) for several weeks to get the players in. then go to people that never come to the races. Given them free buffets and free $1 vouchers. You can't just put it in the program ice cold. We need non-regulars coming in to play it and you have to give them a reason to come. Free buffet for these groups with prizes, etc. New blood. Our regulars will play if the pools are there. Then simulcast the pools. Net pool pricing will be O.K. (Unpublished article by Richard A. Herbert, submitted with the priority provisional application.)

The foregoing disclosure of specific embodiments is intended to be illustrative of the broad concepts comprehended by the invention.

The invention claimed is:

1. A wagering system comprising:

a processor through which information regarding a plurality of competing contestants including at least first and second competing contestants in a horse or dog race is made available to entities betting on the outcome of the race to seek a payout from a first wagering pool, the information for the first of the competing contestants prepared based upon selected handicapping criteria to give the first of the competing contestants a time adjusted race identity and the information for the second of the competing contestants prepared based upon the selected handicapping criteria to give the second of the competing contestants one of: a) a time adjusted race identity; or b) an unadjusted race identity so as to make the first and the second of the competing contestants equally likely to win the race for wagering purposes; and an input for wagers to be placed on the race, the outcome of the race for wagering purposes determined by a time adjusted order of finishing for the first and second of the competing contestants using the time adjusted race identity for the first of the competing contestants and the one of the: a) time adjusted race identity; or b) the unadjusted race identity for the second of the competing contestants.

2. The wagering system according to claim 1 wherein at least one of the plurality of competing contestants has a first unadjusted race identity and those competing contestants in the plurality of competing contestants that do not have the first unadjusted race identity have a time adjusted race identity that is determined based upon the selected handicapping criteria to make all of the competing contestants in the plurality of competing contestants substantially equally likely to win the race for wagering purposes.

3. The wagering system according to claim 1 wherein the criteria comprise at least one of: past race performance; weather conditions; jockey or driver; trainer; and post position.

4. The wagering system according to claim 1 wherein the wagering system further comprises a display upon which the outcome of the race for wagering purposes is visually identifiable for betting entities following the race.

5. The wagering system according to claim 1 wherein the processor is configured to accept data relative to finishing times in the race for each of the plurality of competing contestants and use the data to determine the outcome of the race for wagering purposes.

6. The wagering system according to claim 5 wherein the outcome of the race for wagering purposes is identified as the calculated order of finishing for each of the plurality of contestants and the finishing order for the first of the competing contestants for wagering purposes is determined by using an adjusted finishing time calculated for the first of the competing contestants using an actual finishing time adjusted by a time increment for the first of the competing contestants based upon the selected handicapping criteria.

7. The wagering system according to claim 6 wherein each of a plurality of the competing contestants has an adjusted finishing time, with the adjusted finishing times compared to identify the order of finishing for wagering purposes for each of the plurality of contestants.

8. The wagering system according to claim 1 wherein at least one of the plurality of competing contestants has a first unadjusted race identity with an unadjusted finishing time and the adjusted and unadjusted finishing times are compared to identify the order of finishing for wagering purposes for each of the plurality of contestants.

9. A method of wagering comprising:

providing a processor through which information regarding a plurality of competing contestants in a race is made available to entities betting on particular outcomes of the race to seek a payout from a first wagering pool, inputting information to the processor relative to the competing contestants prepared based upon selected handicapping criteria to give each of the competing contestants either a time adjusted race identity or an unadjusted race identity with at least one of the competing contestants having a time adjusted race identity, for each competing contestant with a time adjusted race identity, the time adjusted race identity being correlated to an adjusted finishing time at the end of the race calculated using an actual finishing time at the end of the race adjusted by a time increment based upon the selected handicapping criteria;

accepting wagers from the entities betting on particular outcomes of the race;

after the race is ended, determining a time adjusted order of finishing for wagering purposes for each of the competing contestants by comparing the time adjusted finishing times for any of the competing contestants that have a time adjusted race identity with actual finishing times for any of the competing contestants that have an unadjusted race identity; and making a payout from the first wagering pool to any entity that bet on a winning outcome of the race based upon the time adjusted order of finishing for each of the competing contestants.

10. The method of wagering according to claim 9 further comprising the step of displaying the time adjusted order of finishing for each of the competing contestants.

11. The method of wagering according to claim 9 further comprising the step of accepting additional wagers and providing an additional payout based on the outcome of the race using a second format that is different than a first format for determining a payout as set forth in claim 9 and without using a time adjusted race identity for any of the competing contestants.

12. The method of wagering according to claim 9 wherein the race is a horse or dog race and the step of inputting information to the processor comprises inputting information prepared based upon selected handicapping criteria that is at least one of: past race performance; weather conditions; jockey or driver; trainer; and post position.

13. The method of wagering according to claim 9 wherein the race is a horse or dog race.

14. The method of wagering according to claim 9 wherein at least one of the plurality of competing contestants has a first unadjusted race identity and those competing contestants in the plurality of competing contestants that do not have the first unadjusted race identity have a time adjusted race identity that is determined based upon the selected criteria to make all of the competing contestants in the plurality of competing contestants substantially equally likely to win the race for wagering purposes.

15. The method of wagering according to claim 11 wherein the first and second formats provide payouts from the first wagering pool.

16. The method of wagering according to claim 11 wherein the first and second formats provide payouts from separate wagering pools.

17. A method of wagering comprising:

identifying a plurality of competing contestants in a race;

based upon selected handicapping criteria, giving each of the competing contestants either a time adjusted race identity or an unadjusted race identity with at least one of the competing contestants having a time adjusted race identity, for each competing contestant with a time adjusted race identity, the time adjusted race identity for that competing contestant being correlated to an adjusted finishing time at the end of the race calculated using an actual finishing time at the end of the race adjusted by a time increment based upon the selected handicapping criteria;

accepting wagers from the entities betting on particular outcomes of the race;

determining a time adjusted order of finishing for each of the competing contestants by comparing the time adjusted finishing times for any of the competing contestants that have a time adjusted race identity with actual finishing times for any of the competing contestants that have an unadjusted race identity; and making a payout from a wagering pool to any entity that bet on a winning outcome of the race based upon the time adjusted order of finishing for each of the competing contestants.

18. The method of wagering according to claim 17 further comprising the step of displaying the time adjusted order of finishing for each of the competing contestants.

19. The method of wagering according to claim 17 further comprising the step of accepting additional wagers and providing an additional payout based on the outcome of the race using a second format that is different than a first format for determining a payout as set forth in claim 17 and without using a time adjusted race identity for any of the competing contestants.

20. The method of wagering according to claim 17 wherein the race is a horse or dog race and the step of inputting information to the processor comprises inputting information prepared based upon selected handicapping criteria that is at least one of: past race performance; weather conditions; jockey or driver; trainer; and post position.

21. A method of wagering comprising the steps of:

providing a processor through which information regarding a plurality of competing contestants in a race is made available to entities betting on particular outcomes of the race to seek a payout;

inputting information to the processor relative to at least one competing contestant prepared based upon selected handicapping criteria to give the at least one competing contestant a time adjusted race identity, the time adjusted race identity for the at least one competing contestant correlated to an adjusted finishing time at the end of the race calculated using an actual finishing time at the end of the race adjusted by a time increment based upon the selected handicapping criteria;

accepting wagers from the entities betting on particular outcomes of the race; and after the race is ended, making a payout to any entity that places a wager that identifies both: a) an unadjusted finishing order utilizing the actual finishing time for the at least one competing contestant; and b) an adjusted finishing order utilizing the adjusted finishing time for the at least one competing contestant.

* * * * *